United States Patent [19]

Nilsson

[11] Patent Number: 4,969,839

[45] Date of Patent: Nov. 13, 1990

[54] ELECTRICAL CONNECTOR

[75] Inventor: Carl R. Nilsson, Greenville, S.C.

[73] Assignee: Dill Products Incorporated, Norristown, Pa.

[21] Appl. No.: 456,217

[22] Filed: Dec. 21, 1989

Related U.S. Application Data

[63] Continuation of Ser. No. 282,574, Dec. 12, 1988, abandoned, which is a continuation of Ser. No. 147,121, Jan. 21, 1988, abandoned, which is a continuation of Ser. No. 936,936, Dec. 1, 1986, abandoned, which is a continuation of Ser. No. 494,356, May 13, 1983, abandoned.

[51] Int. Cl.[5] ..... H01R 4/24

[52] U.S. Cl. ..... 439/395

[58] Field of Search ..... 439/391–426

[56] References Cited

U.S. PATENT DOCUMENTS

| | | | |
|---|---|---|---|
| 1,374,529 | 4/1921 | Simmons | 339/103 R |
| 3,274,530 | 9/1966 | Michaely | 339/97 P |
| 3,786,173 | 1/1974 | Vogt | 339/98 |
| 3,907,395 | 9/1975 | Flanagan | 339/99 R |
| 3,980,380 | 9/1976 | Cieniawa et al. | 339/99 R |
| 4,178,056 | 12/1979 | Lee | 339/103 R |
| 4,449,777 | 5/1984 | Baribeau | 339/99 R |

*Primary Examiner*—Joseph H. McGlynn

*Attorney, Agent, or Firm*—William H. Elliott, Jr.; Richard D. Weber

[57] ABSTRACT

A multi-conductor terminal is disclosed which connects a plurality of discrete electrical connectors without the need for stripping insulation from the conductors.

1 Claim, 4 Drawing Sheets

ELECTRICAL CONNECTOR

This is a continuation of copending application(s) Ser. No. 07/282,574, filed on Dec. 12, 1988, now abandoned which is a continuation of application Ser. No. 07/147,121, filed Jan. 21, 1988, now abandoned, which is a continuation of Ser. No. 06/936,936, filed Dec. 1, 1986 abandoned, which is a continuation of Ser. No. 06/494,356, filed May 13, 1983, abandoned.

BACKGROUND OF THE INVENTION

This invention relates generally to the art of electrical connectors, and more particularly to the art of an electrical connector for use on multi-conductor cables of the type utilized to connect a tractor-trailer rig.

Tractor-trailer rigs have conventionally required the use of uniform connectors such that virtually any tractor may be coupled with any trailer and the trailer provided with necessary electrical power for road operation. Conventionally, this has been done with a seven-conductor cable utilizing a conventional male/female interconnect. These interconnectors are arranged within a cylindrical terminal housing of about one and one-half inches (1½") diameter. The terminals are arranged generally about the center of the cylindrical housing with the seventh terminal being axially disposed along the center thereof. Examples of such terminals are disclosed in U.S. Pat. No. 4,304,457 which is herewith incorporated by reference.

The terminals within the terminal holder are connected to individual discrete conductors emanating from a cable sheathed with insulation. Each of the discrete conductors also has insulation thereon.

Conventional electrical interconnectors of this type are subject not only to road wear and soiling, but also to a certain amount of abuse and neglect during normal operation. For example, tractors are frequently mechanically detached from trailers while neglecting to disconnect the electrical connection, resulting in destruction of either the cable or the electrical interconnector upon movement of the tractor away from the trailer.

Due to such abuse and normal wear and tear, electrical connectors between tractor and trailer are subject to frequent replacement. Conventionally, mechanics have had to sever the cable, strip a portion of insulation from the cable, and then strip insulation from the individual discrete connector contained therein. It is then necessary for the mechanic to connect the individual conductors to the terminals of the connector utilizing a set screw for retaining each individual conductor in electrical contact with each terminal. There is, thus, significant labor involved in the maintenance of electrical interconnectors for tractor-trailer rigs.

SUMMARY OF THE INVENTION

It is thus an object of this invention to provide a novel electrical connector.

It is a further object of this invention to provide a novel electrical connector for use on multi-conductor cables.

It is still a further and more particular object of this invention to provide a novel connector for a multi-conductor cable which may be installed and replaced with only a small amount of labor.

It is a yet further object of this invention to provide such a connector wherein discrete conductors having insulation thereon may be attached without the need to strip insulation therefrom.

These as well as other objects are accomplished by a connector having a cable holder with a plurality of retaining means for discrete electrical conductors having insulation thereon and a terminal holder which mates therewith having a plurality of insulation piercing conducting members in alignment with the retaining means for piercing the insulation thereof and establishing electrical communication.

DETAILED DESCRIPTION

In accordance with this invention it has been found that multi-conductor cables may be quickly and easily attached to a connector in accordance with this invention with significantly less labor than has heretofore been required. The connector in accordance with this invention not only eliminates the need for stripping insulation from individual conductors, but also eliminates the need for attaching the individual conductors to the conductor terminals by means of set screws. Various other advantages will become apparent from the following description given with reference to the various figures of drawing.

Figure 1:
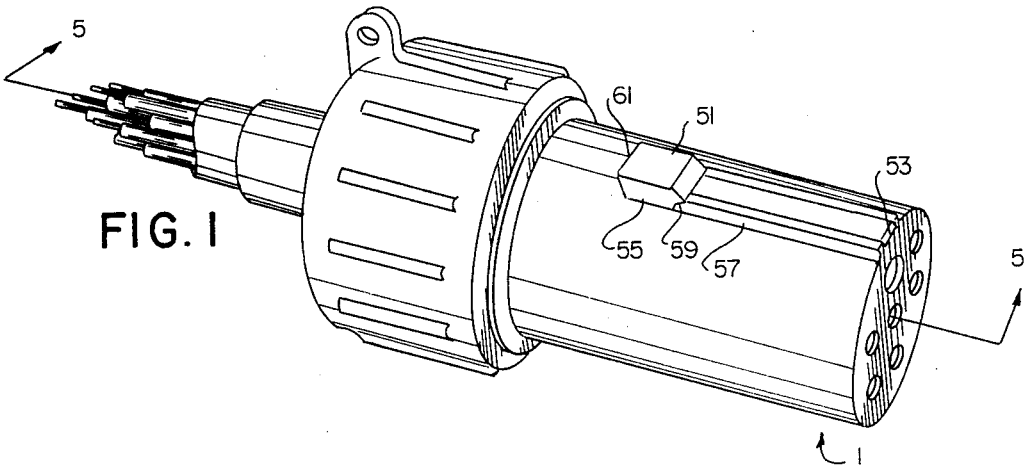
FIG. 1 of the drawings illustrates in perspective view a connector in accordance with this invention.

FIG. 1 of the drawings illustrates a connector 1 in accordance with this invention. FIG. 1 of the drawings, for all practical purposes, has substantially the same dimensions as the exterior of a conventional connector.

Figure 2:
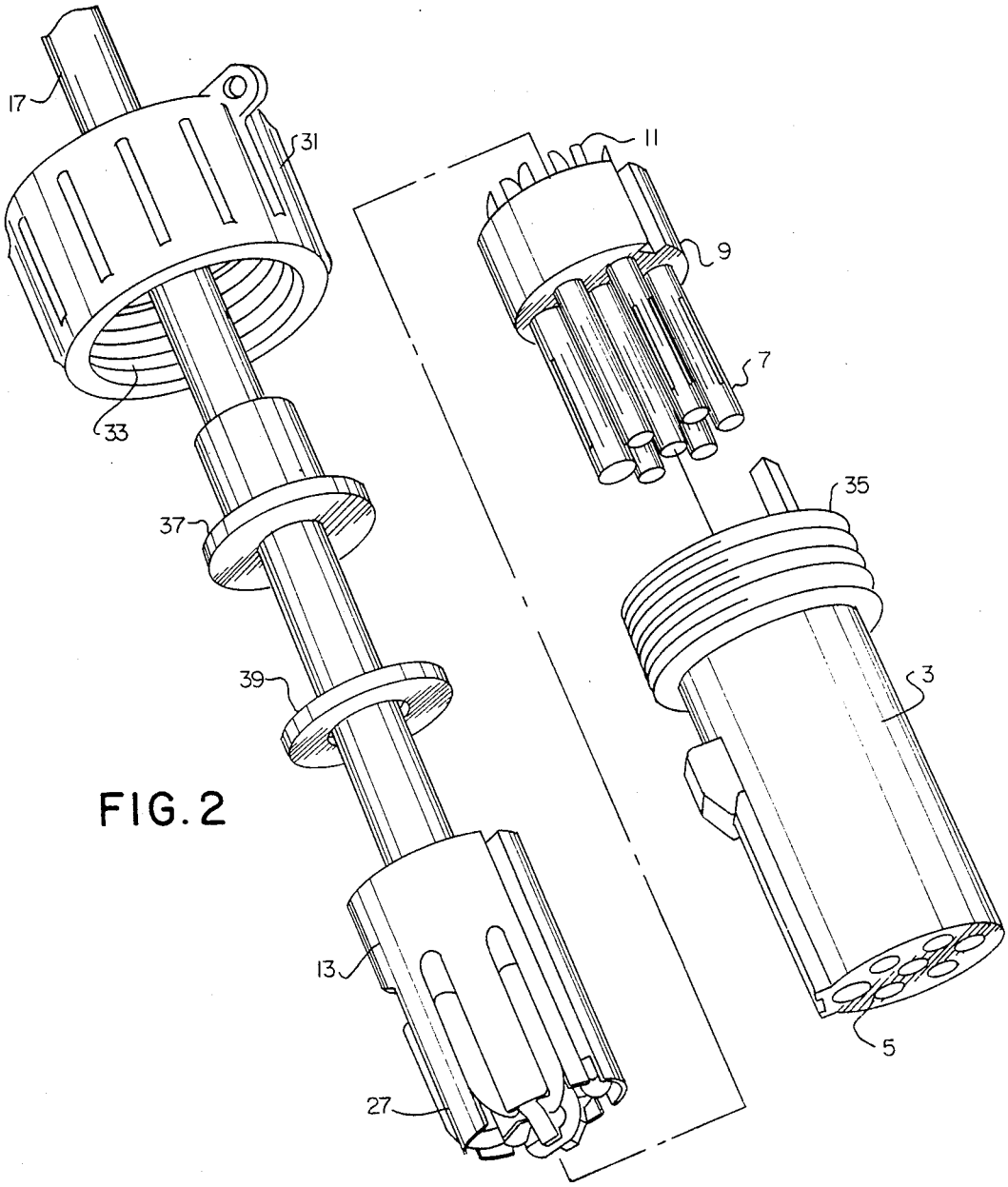
FIG. 2 of the drawings illustrates a perspective assembly view of the connector in accordance with this invention.

FIG. 2 of the drawings illustrates the connector 1 of FIG. 1 in an assembly view. For purposes of this description, the terms "proximate" and "distal" will be utilized in referring to the structure illustrated in FIG. 2 as to whether those elements are respectively either near or far in the FIG. 2 view. The connector 1 in accordance with this invention comprises a terminal housing 3 having openings 5 at the proximal end thereof for exposing generally hollow terminals 7 which form a part of terminal holder 9. Terminal holder 9 also additionally has insulation piercing conducting members 11 which are in fact the distal end of terminals 7 and which form the distal end of terminal holder 9. Terminal holder 9 nests within terminal housing 3 as is best illustrated in the assembly view of FIG. 3 which is an assembly view from the opposite direction of that illustrated in FIG. 2. Immediately adjacent terminal holder 9 is cable holder 13. Cable holder 13 defines a passage 15 through the central portion thereof for receipt of cable 17.

Figure 3:
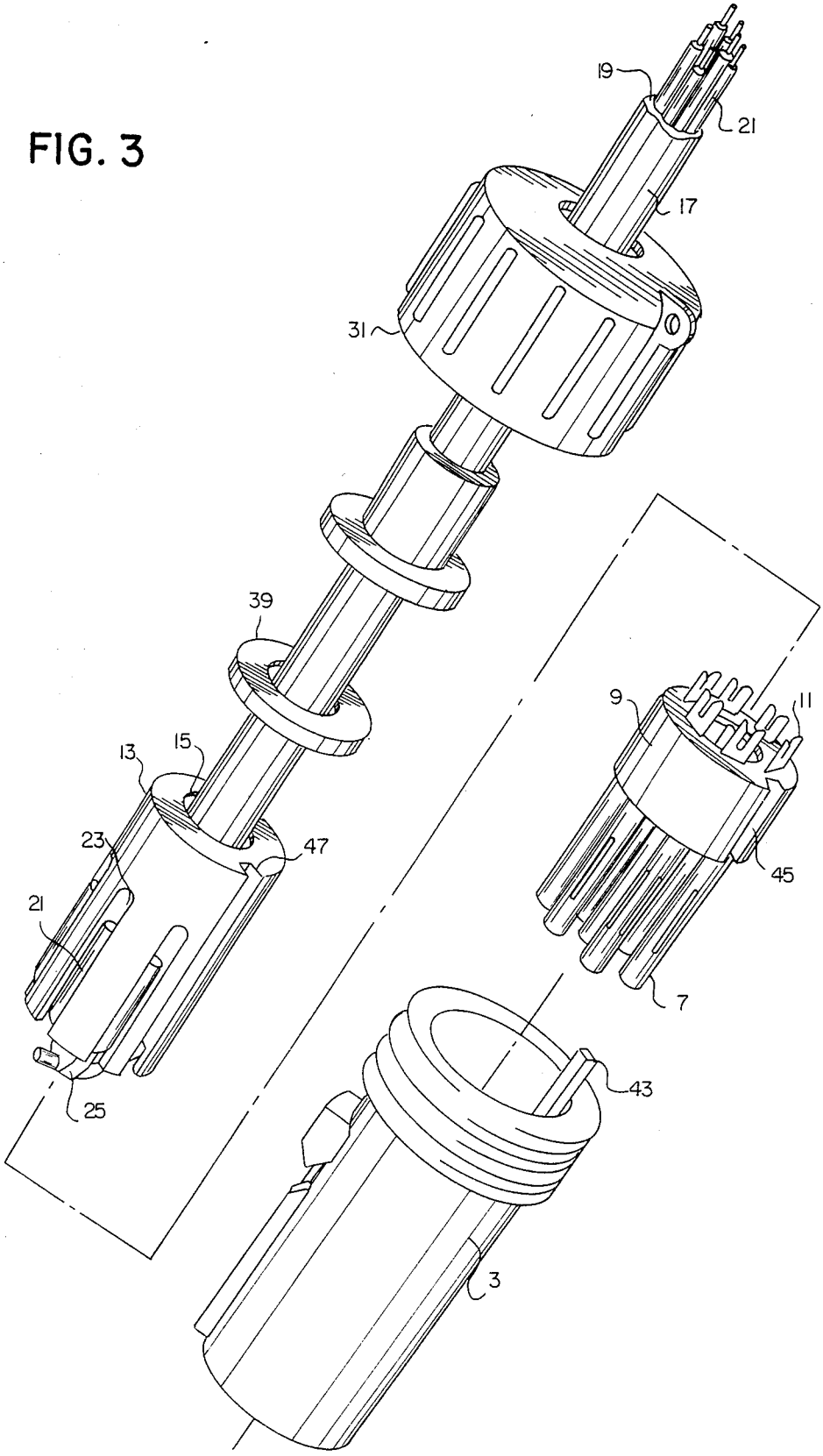
FIG. 3 of the drawings illustrates a perspective assembly view in a direction opposite to that of FIG. 2 of the drawings.

As can best be seen in the FIG. 3 view, cable 17 comprises an outer sheathing of insulation 19 which encompasses a plurality of individual conductors 21 with insulation thereon. FIGS. 2 and 3 illustrate cable 17 entering passageway 15 of cable holder 13 through the distal end thereof. The cable with a portion of the sheathing 19 removed therefrom passes through the proximal end of cable holder 13 where the individual conductors with insulation thereon are splayed into retaining means 23. It is seen that the retaining means 23 comprise a plurality of slots about the cable holder 13 for receiving individual conductors 21. Each of the retaining means 23 may be color coded to assist in proper placement of conductors 21 of cable 17. In the embodiment here depicted, six retaining means are on the peripheral surface of the cable holder 13, and one retaining means 25 is in the central portion of cable holder 13. It is seen that cable holder 13 has an annular slot 27 about the proximal end thereof across which individual conductors 21 are splayed for receipt into the retaining means 23.

Insulation piercing conducting members 11 are in alignment with each of the retaining means of cable holder 13 so that when the assembly is nested within the terminal housing, the insulation piercing conducting members cross the path of individual conductors and, due to the configuration thereof, pierce the insulation of the individual conductors and establish electrical communication between the individual conductors and the appropriate terminal 7. It can be seen that nesting causes the conductors 21 to wedge into insulation piercing conducting members 11.

Figure 4:
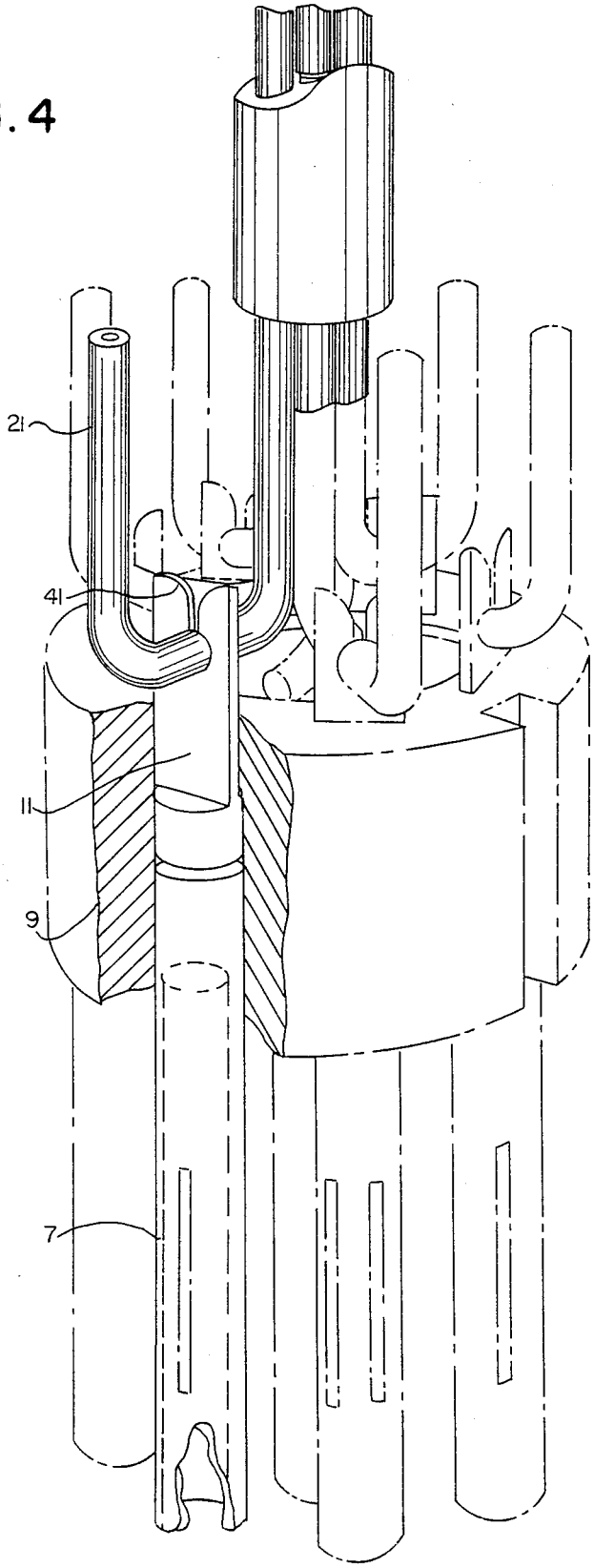
FIG. 4 of the drawings illustrates a closeup of a portion of a connector in accordance with this invention.

The insulation piercing capability of the connector in accordance with this invention is best illustrated in FIG. 4 of the drawings wherein terminal holder 9 is illustrated with insulation piercing conducting members 11 piercing the insulation of individual conductors 21 as they are illustrated in their configuration when retained within cable holder 13. For purposes of clarity, the cable holder 13 is not illustrated in FIG. 4, but for all practical purposes, the cable holder and the retaining means thereof maintain the individual conductors 21 in the configuration illustrated in FIG. 4 to assure that the insulation piercing conducting members 11 establish electrical contact with the appropriate conductor.

The connector is substantially closed by rear housing 31 which adjustably attaches to terminal housing 3 by threaded connections 33 and 35, respectively. A rubber bushing 37 and thrustwasher 39 transmit the force from rear housing 31 to cable holder 13 and terminal holder 9 as the rear housing is adjustably coupled with terminal housing 3. It is seen that the force of compression caused by appropriate adjustment forces insulation piercing through the insulation of individual conductors 21.

As best illustrated in FIGS. 3 and 4 of the drawings, the insulation piercing conducting members 11 define a sharpened, v-shaped slot 41 for cutting through the insulation of the insulated conductors 21 and for impinging upon the conductor thereof for establishing electrical communication.

In most instances conductors 21 each comprise a plurality of conducting strands which are arranged into a circular cross-sectional configuration. When using a conductor formed of such strands, the strands are forced from the circular configuration into a "v" shape due to the wedging thereof into "v" shaped slot 41.

As best illustrated in FIG. 3 of the drawings, terminal housing 3 comprises on the interior thereof a key 43 for alignment with a keyway 45 and 47 of terminal holder 9 and cable holder 13 to assure proper alignment thereof.

Figure 5:
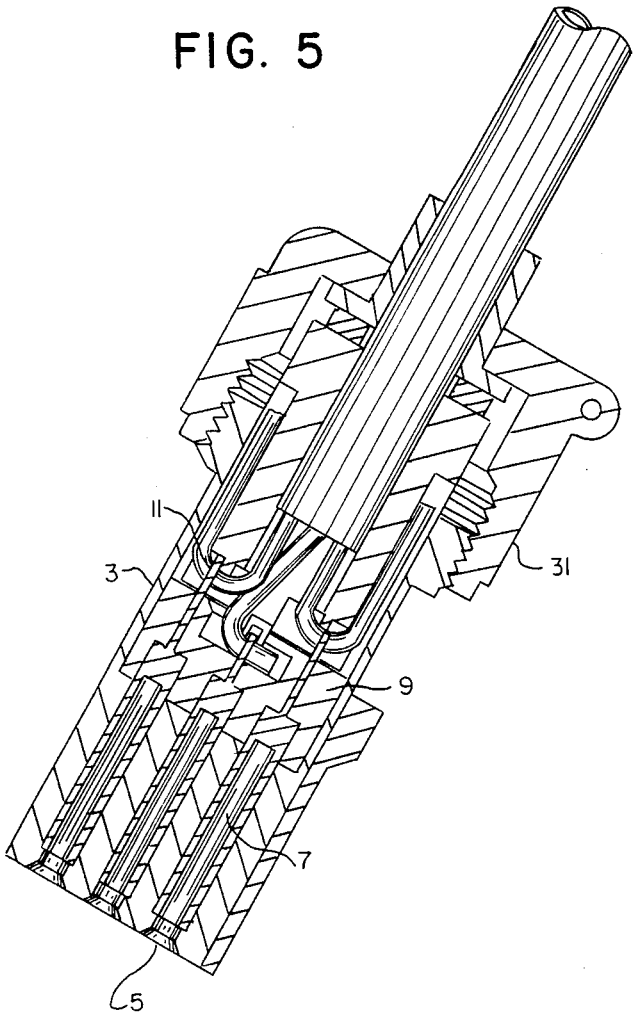
FIG. 5 of the drawings is a cross section view along the line 5—5 of FIG. 1.

FIG. 5 of the drawings is a cross section view along the line 5—5 of FIG. 1. This view illustrates the various components completely assembled.

The connector 1 in accordance with this invention is adapted to be received into a receptacle of the type illustrated in U.S. patent application No. 4,304,457 above referenced. Such receptacle includes a hinged cover which mates with a locking mechanism having a cross section similar to the locking mechanism 51 illustrated in FIG. 1 of the drawings. Locking mechanism 51 in accordance with this invention, however, comprises a passageway 53 defined by the outer surface of terminal housing 3 for receipt of a plug assembly retainer 55 which fits into slot 53. It is seen that the distal end 57 of slot 53 is defined by an inclined surface. Plug assembly 51 mates with a similarly but matingly inclined surface 59. A locking mechanism from a receptacle rests at distal end of plug assembly retainer at 61. Thus in accordance with this invention, if an electrical connection is inadvertantly maintained when mechanical disconnection between a tractor and trailer occurs, the force exerted on the connector of this invention will be concentrated on surface 61, and due to the inclined surface at 59, the plug assembly retainer is destroyed permitting the connector 1 to fall free without deleterious effects other than destruction of the plug assembly retainer 51 which is simply replaced.

It is thus seen that the connector in accordance with this invention provides a novel multi-conductor terminal for use in connecting a tractor and trailer. It is seen that the connector in accordance with this invention is easily maintenanced and replaced with only a fraction of the labor associated with replacement of conventional connectors. As many variations will be apparent to those of skill in the art from a reading of the above description, such variations are within the spirit and scope of this invention as defined by the following appended claims.

What is claimed is:

1. A connecting socket device for a cable for electrical communication with a connecting plug device which comprises a plurality of discrete electrical conductors contained within a cable insulation, but with each discrete conductor having insulation thereon, comprising:

a cable holder having a proximal end and a distal end defining a plurality of retaining slots on the exterior thereof for said discrete electrical conductors having insulation thereon and defining through the center there of a passageway for said cable, said cable holder further defining a generally annular slot at the proximal end thereof running transverse to said retaining slots whereby said individual conductors cross said annular slot as they proceed from said passageway to said retaining slots;

pierce members defining with sharpened edges a "V"-shaped slot, said "V"-shaped slot crossing the path of individual discrete conductors in alignment with said annular slot for piercing the insulation on said discrete conductors as they cross said annular slot so as to establish electrical communication between said discrete conductors and said insulation piercing conducting members without the necessity of stripping insulation from individual discrete conductors; and terminals in electrical communication with said pierce members for electrical communication with contacts of a connecting plug device.

* * * * *